US010271127B2

(12) United States Patent
Hurrell et al.

(10) Patent No.: US 10,271,127 B2
(45) Date of Patent: Apr. 23, 2019

(54) HIGH PERFORMANCE LOW PROFILE TOP SPEAKER

(71) Applicant: Apple Inc., Cupertino, CA (US)

(72) Inventors: David A. Hurrell, San Mateo, CA (US); Tyler B. Cater, San Jose, CA (US); Scott P. Porter, Inglewood, CA (US); Salome Bavetta, Sunnyvale, CA (US); Anthony P. Grazian, Los Gatos, CA (US); Benjamin J. Pope, Sunnyvale, CA (US); Scott A. Myers, Saratoga, CA (US); Ashutosh Y. Shukla, Playa Vista, CA (US); Benjamin M. Russo, Santa Clara, CA (US); Christopher Wilk, Los Gatos, CA (US); David MacNeil, Cupertino, CA (US); Eric N. Nyland, Santa Clara, CA (US); Ihtesham H. Chowdhury, Los Altos, CA (US); Joseph F. Maldonado, Rohnert Park, CA (US); Kevin M. Froese, San Francisco, CA (US); Richard Hung Minh Dinh, Saratoga, CA (US); Ruchir M. Dave, San Jose, CA (US); Teemu P. Sipila, Campbell, CA (US); Yang Liu, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/648,106

(22) Filed: Jul. 12, 2017

(65) Prior Publication Data

US 2019/0020943 A1 Jan. 17, 2019

(51) Int. Cl.
*H04R 1/28* (2006.01)
*H04R 9/02* (2006.01)
(Continued)

(52) U.S. Cl.
CPC ..... *H04R 1/2811* (2013.01); *H04R 5/02* (2013.01); *H04R 9/02* (2013.01); *H04R 1/02* (2013.01); *H04R 2499/11* (2013.01)

(58) Field of Classification Search
CPC ..... H04R 1/2811; H04R 1/02; H04R 1/2846; H04R 1/2838; H04R 1/2823; H04R 5/02; H04R 2499/11
See application file for complete search history.

(56) References Cited

U.S. PATENT DOCUMENTS 6,176,345 B1 * 1/2001 Perkins ..... H04R 7/00 181/171
6,490,363 B1 * 12/2002 Liu ..... H04R 9/06 381/398
(Continued)

*Primary Examiner* — Fan S Tsang
*Assistant Examiner* — Angelica M McKinney
(74) *Attorney, Agent, or Firm* — Kilpatrick Townsend & Stockton LLP

(57) ABSTRACT

This disclosure describes a speaker assembly suitable for use in a portable electronic device utilizing water resistant ports. The speaker assembly can have an open back that subjects a back volume of the speaker to pressure differentials within a device housing of the portable electronic device. The speaker assembly can utilize a speaker surround having a varying thickness. The varying thickness speaker surround allows the speaker to maintain an acceptable frequency response profile while limiting the travel of the diaphragm it is coupled with. The disclosure also describes how electrically conductive pathways can be integrated within a housing of the speaker assembly.

19 Claims, 12 Drawing Sheets

(51) Int. Cl.
*H04R 5/02* (2006.01)
*H04R 1/02* (2006.01)

(56) References Cited

U.S. PATENT DOCUMENTS

| | | | | |
|---|---|---|---|---|
| 8,922,586 | B2 * | 12/2014 | Duran | G06F 1/1626 345/629 |
| 9,820,038 | B2 * | 11/2017 | Salvatti | H04R 1/44 |
| 2003/0190051 | A1 * | 10/2003 | Williamson | H04R 9/06 381/398 |
| 2005/0190941 | A1 * | 9/2005 | Yang | H04R 1/2819 381/351 |
| 2011/0064260 | A1 * | 3/2011 | Andersen | H04R 7/20 381/430 |
| 2013/0063920 | A1 * | 3/2013 | Farahani | G06F 1/1637 361/807 |
| 2013/0170688 | A1 * | 7/2013 | Cohen | H04R 1/30 381/340 |
| 2016/0037243 | A1 * | 2/2016 | Lippert | H04R 1/023 381/166 |
| 2016/0073182 | A1 * | 3/2016 | Kole | H04R 1/023 381/386 |
| 2016/0205477 | A1 * | 7/2016 | Kuribayashi | H04R 1/028 381/334 |
| 2017/0064438 | A1 * | 3/2017 | Wilk | H04R 1/2811 |
| 2017/0085992 | A1 * | 3/2017 | Vitt | H04R 9/025 |

* cited by examiner

*B-B*

*C-C*

*D-D*

HIGH PERFORMANCE LOW PROFILE TOP SPEAKER

FIELD

The described embodiments relate generally to a speaker assembly for an electronic device. In particular, the speaker assembly can be designed to operate in a pressure variable environment.

BACKGROUND

Integrating a speaker within a small form factor electronic device can be challenging on account of the need to integrate a component into a compact space. Furthermore, speakers generally need a substantial back volume of air to effectively playback audio. While a larger back volume of air generally improves the performance of a speaker it also increases the component size making integration of the speaker within the device more challenging. By opening the rear of the speaker to an interior volume of air within the small form factor electronic, the back volume for the speaker can be substantially enlarged by taking advantage of space available between and around other electrical components within the small form factor electronic device. Unfortunately, when the small form factor device is a water resistant device with water seals that impede the efficient movement of air into and out of the device, any movement or deformation of the device housing that changes the size of an interior volume within the small form factor electronic device can result in substantial changes in the air pressure within the device. Changes in the air pressure can adversely affect the speaker when the back volume of the speaker is open to the interior volume of the device since a pressure differential within the speaker module can prevent normal operation of a diaphragm of the speaker. Consequently, an improved way of incorporating speakers and their associated moving parts within the interior volume of a small form factor electronic device is desirable.

SUMMARY

This disclosure describes various embodiments that relate to a speaker assembly for a small form factor portable electronic device.

A portable electronic device is disclosed and includes the following: a speaker assembly having a speaker housing defining an interior volume, a diaphragm disposed within the interior volume, and a speaker surround coupling the diaphragm to sidewalls of the speaker housing, the speaker surround having a tapered geometry.

A small form factor electronic device is disclosed and includes the following: a device housing defining an interior volume and a speaker assembly. The speaker assembly includes a speaker housing, a diaphragm disposed within the speaker housing, and a speaker surround coupling the diaphragm to the speaker housing. The speaker surround includes a first portion coupled to a periphery of the diaphragm, a second portion coupled to an interior surface of the speaker housing, and a third portion joining the first portion to the second portion, the third portion being substantially thinner than the first portion and the second portion.

A portable electronic device is disclosed and includes: a housing defining a front opening and one or more water-resistant ports extending through a sidewall of the housing; a display assembly covering the front opening and cooperating with the housing to define an interior volume; and a speaker assembly. The speaker assembly includes a speaker housing, a diaphragm, and a speaker surround coupled to and extending around a periphery of the diaphragm, the speaker surround also being coupled to the speaker housing and having a tapered geometry that limits displacement of the diaphragm without degrading the frequency response of the diaphragm.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
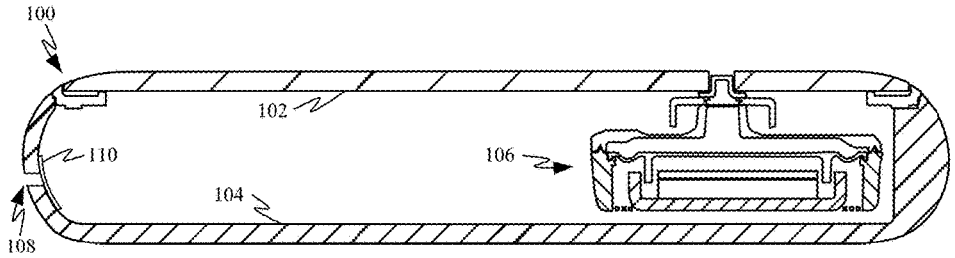
FIGS. 1A-1C show cross-sectional views of a portable electronic device having a speaker module with a diaphragm moving due to pressure variation within the portable electronic device.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Portable electronic devices often include speakers in order to add the ability to play back audio content to a user without the user needing to utilize headphones anytime audio or video playback is desired. Unfortunately, speakers can take up substantial amounts of space within a portable electronic device due to the volume of air generally needed to achieve a threshold quality of audio output. One commonly used method of obtaining the additional air volume generally needed to achieve high quality audio output is using an open-back speaker that utilizes space available within the portable electronic device housing to augment the audio playback. When that portable electronic device has seals that prevent the inflow of water into the device and portions of the portable electronic device are configured to deform, pressure within the device can increase rapidly due to airflow into and out of the device being limited by the water seals when the device is deformed in a way that reduces the space within the device. Unfortunately, rapid changes in air pressure within the device also manifest as air pressure changes in the back volume of the open-back speaker. This rise in pressure in the back volume can result in the diaphragm of the speaker being forced upwards far enough to substantially prevent vibration of the diaphragm. Similarly, when the device returns to its undeformed state after at least some of the high pressure air within the device has escaped, a low pressure state can result causing the diaphragm to be forced downwards into a position that causes the coil and/or diaphragm to crash into a motor structure of the voice coil motor and generate objectionable levels of distortion and, in some cases, also prevents vibration of the diaphragm.

One solution to this problem is to increase the thickness and stiffness of a speaker surround associated with the diaphragm. Since the speaker surround is what holds the diaphragm in place within the speaker assembly, stiffening this element can prevent the diaphragm from being moved too far out of its operating position during unanticipated pressure excursions. Unfortunately, a change in stiffness of the diaphragm can have a great effect on the frequency response of the diaphragm. In order to preserve the frequency response of the diaphragm the thickened speaker surround can be implemented with a tapered geometry that leaves a narrow portion of the speaker surround thin enough to achieve a good frequency response. By limiting the size of the thin region of the speaker surround a maximum deflection of the speaker surround can be limited to an amount that prevents contact between the diaphragm and interior surfaces of the speaker assembly during pressure excursions.

Another limitation faced by speaker assemblies is the total area taken up by the speaker assembly within a portable electronic device. In particular, speaker performance can be improved by increasing the total area of the diaphragm. For this reason, any components that extend vertically through the speaker assembly can limit the size of the diaphragm for a speaker assembly needing to fit within a fixed area. For example in some embodiments, electrical connectors can extend through a speaker assembly in order to facilitate routing power through the speaker assembly. Unfortunately, the electrical connectors can impinge on space that could otherwise be used to increase the size of the diaphragm.

One solution to this problem is to mount electrical connectors atop the speaker assembly and then integrate electrically conductive pathways into the walls of the housing itself. In this way, the electrically conductive pathways can carry power and/or data through the housing without taking up space that could otherwise be used to increase the size of the diaphragm. In some embodiments, the electrically conductive pathways can take the form of contact bars insert-molded within a plastic housing component. Once the contact bars carry the signals and/or power beneath the level where the diaphragm is located wires can be used to route the power and/or data to electrical components to different locations and components within the speaker assembly. In other embodiments, electrically conductive pathways can be routed along an exterior surface of the housing of the speaker assembly.

These and other embodiments are discussed below with reference to FIGS. 1A-8B; however, those skilled in the art will readily appreciate that the detailed description given herein with respect to these figures is for explanatory purposes only and should not be construed as limiting.

FIG. 1A shows a cross-sectional view of an exemplary portable electronic device 100. Portable electronic device 100 includes coverglass 102 and housing 104, which cooperate to define an interior volume. For explanatory purposes only, the discussion herein of electrical components within the interior volume is limited to speaker assembly 106. Speaker assembly 106 can have an open back architecture, which allows speaker assembly 106 to use the interior volume as an expanded back volume for improving performance of speaker assembly 106. In some embodiments, the interior volume can be sealed to keep water from entering into the interior volume. While housing 104 defines a vent 108 for allowing the inflow and outflow of air, due to the pore size of membrane 110 needing to be small enough to prevent water from entering device 100 the flow rate of air through membrane 110 can be slow.

Figure 1B:
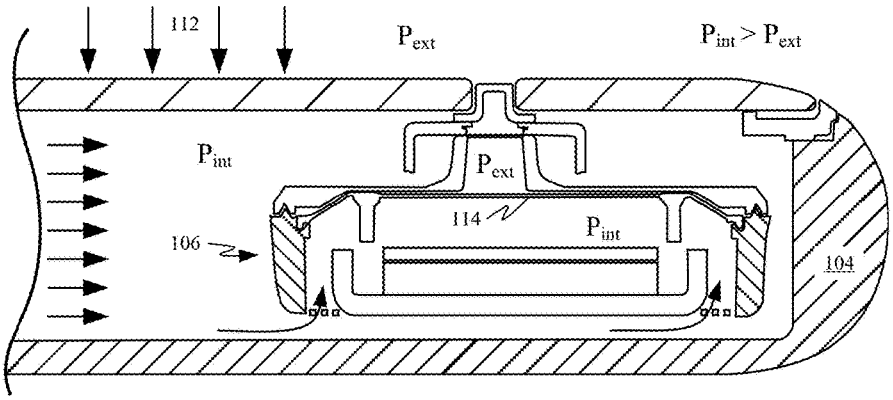
Figure 1C:
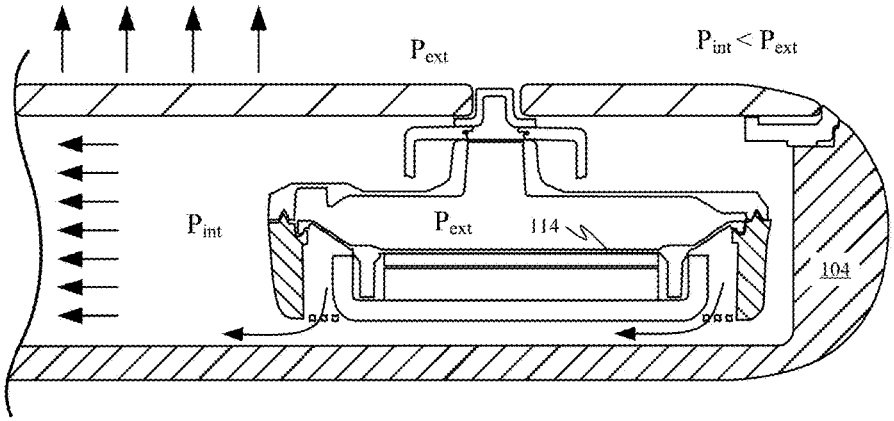

FIG. 1B shows a cross-sectional view of an end of portable electronic device 100 that includes speaker assembly 106. A force 112 is depicted acting on coverglass 102. This force can result in one or both of coverglass 102 and housing 104 deforming inwards. In some embodiments, the device can be purposefully configured to accommodate this deformation so that a sensor associated with portable electronic device 100 can measure the deformation in order to determine how hard a user is pressing on coverglass 102. In some embodiments, deflection of greater than 1 mm can be accomplished by applying a firm press against coverglass 102. This deformation can reduce the size of the interior volume, which can cause a substantial increase in air pressure ($P_{int}$) within the interior volume. This increase in air pressure ($P_{int}$), which also affects the pressure within the speaker assembly up to the downward-facing surface of diaphragm 114, can cause diaphragm 114 to deflect upward due to the lower pressure ($P_{ext}$) outside electronic device 100 and within the front volume of speaker assembly 106. While the built up high pressure can eventually be equalized by air passing through vent 108, release of force 112 after a full or even partial equalization can cause a low pressure event to occur, resulting in diaphragm 114 generating distortion and bottoming out, as shown in FIG. 1C. Unfortunately, both extreme positions of diaphragm 114 shown in FIGS. 1B and 1C prevent speaker assembly 106 from vibrating and therefore from generating audio waves. Consequently, any change in the interior volume of electronic device 100 can result in audio output being adversely affected. Furthermore, in some cases the undesired pressure change can cause damage to diaphragm 114 by stretching diaphragm past its normal operating limits.

Figure 2A:
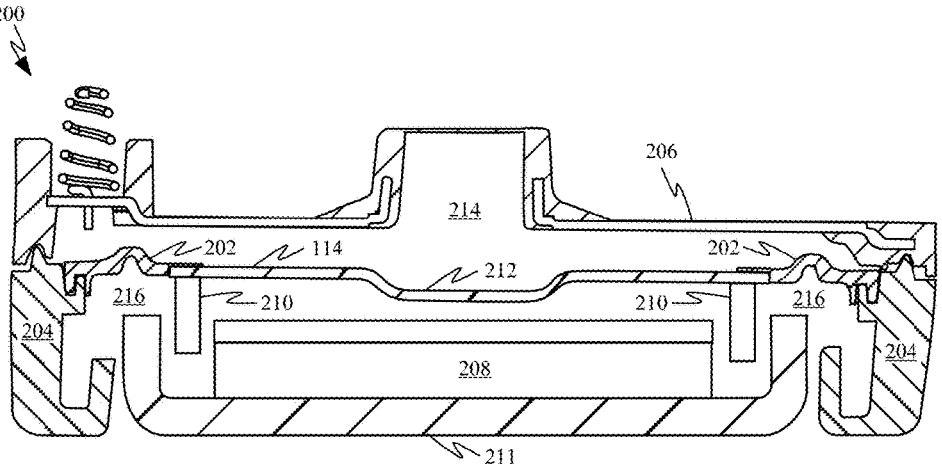
FIG. 2A shows a cross-sectional view of a speaker assembly having a speaker surround optimized to operate in a pressure variable environment.

FIG. 2A shows a cross-sectional view of a speaker assembly 200 optimized to operate in a pressure variable environment. In particular, speaker assembly 200 includes a speaker surround 202 with a pressure resistant geometry. Speaker surround 202 is configured to flexibly couple diaphragm 114 to lower housing component 204. By increasing the thickness of speaker surround 202, the amount of vertical displacement that can be achieved by diaphragm 114 can be reduced in order to prevent diaphragm 114 from contacting upper housing component 206 or magnet assembly 208 during pressure variable operations. Magnet assembly 208 includes a permanent magnet configured to interact with electromagnetic coil 210 to move diaphragm 114 in a pattern that generates audio output. Magnet assembly 208 is supported by a speaker backer 211 that shields electrical components within speaker assembly 200 from both physical and electrical damage. In some embodiments, speaker backer 211 can be formed of stainless steel and can act as a magnetic shunt for preventing a magnetic field emitted by magnet assembly 208 from adversely affecting components external to speaker assembly 200. Speaker backer 211 can interface with lower housing component 204 in a way that leaves openings allowing air to move freely into and out of a back volume of speaker assembly 200.

In some embodiments and as depicted in FIG. 2A, diaphragm 114 can include a central recessed portion 212 that can be implemented to add geometric stiffness to diaphragm 114, helping to shift flexural break-up modes higher in frequency and extend the bandwidth achievable by speaker assembly 200. It should also be appreciated that speaker assembly 200 defines a front volume 214 and a back volume 216. As described above, the size of back volume 216 can be expanded by including vents in speaker assembly 200 that put back volume 216 in fluid communication with the interior volume of the device housing in order to take advantage of unoccupied volume within device 100. Front volume 214 can be in communication with the external environment, generally resulting in front volume 214 having substantially the same quasi-static air pressure as an external environment. Front volume 214 can be sealed off from back volume 216. This allows water and/or other foreign particulates to enter front volume 214 of speaker assembly 200 without risk of other components within the speaker back volume or portable electronic device 100 from being exposed. In some embodiments, speaker surround 202 can be formed from molded silicon that is thick enough to prevent the protruding portion of speaker surround 202 from flipping the opposite direction when front volume 214 is exposed to certain ranges of hydrostatic pressures.

Figure 2B:
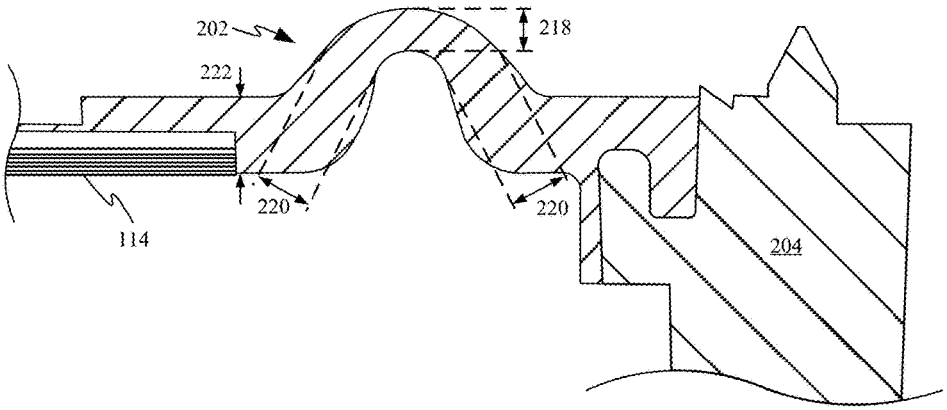
FIGS. 2B-2C show cross-sectional views of different embodiments of a speaker surround having a tapered geometry.

FIG. 2B shows additional details regarding the modified geometry of speaker surround 202. While thickening speaker surround 202 can help to prevent diaphragm 114 from being over stretched during quasi-static pressure excursions, over-thickening speaker surround 202 can degrade the frequency response of diaphragm 114. One way to overcome this difficulty is to use a speaker surround 202 having a tapered geometry. The tapered geometry allows for the portions of speaker surround 202 that attach to diaphragm 114 and to speaker housing component 204 to be thickened while leaving a more flexible curved region free to accommodate vibration of diaphragm 114. Note how thickness 218 is substantially less than thickness 220 and particularly less than thickness 222. In some embodiments, thickness 218 can be between 100 and 150 microns, thickness 220 can be about 30-50% greater than thickness 218 and thickness 222 can be about 70-90% greater than thickness 218. By thinning a select central region of speaker surround 202, the amount of deflection diaphragm 114 is able to accommodate can be tuned to prevent contact between diaphragm 114 and the housing. In this way, when substantial pressure differentials are introduced within speaker assembly 106, diaphragm 114 can continue to operate without substantial disruption. It should be noted that as depicted, diaphragm 114 can be formed from multiple layers of material.

Figure 2C:
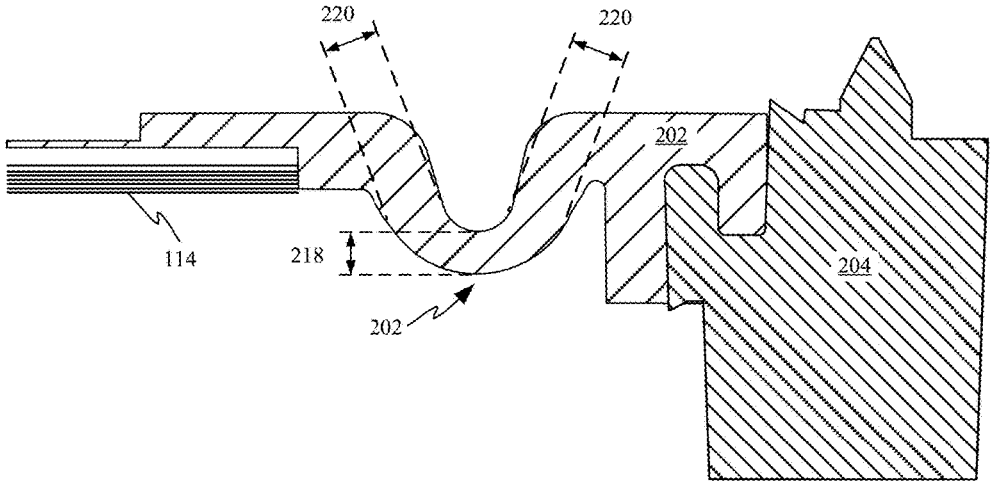

FIG. 2C shows how speaker surround can alternatively be oriented in the opposite direction with similar effect also using a tapered geometry. One benefit of orienting the protruding portion of speaker surround downwards is that it provides additional clearance directly above speaker surround 202, allowing the periphery of the speaker housing to include additional components or have a tapered geometry. This configuration can be desirable when firm user inputs are only expected for short durations, thereby preventing the system from equalizing much before the user input ceases. In this way, the severity of low pressure excursions is minimized. It should be noted that micro speakers used in small form factor electronic devices generally utilize speaker surrounds made from thermoform material. Since thermoform materials have uniform thickness, speaker surrounds made from this material are unable to achieve the tapered speaker surround geometries depicted in FIGS. 2B and 2C.

Figure 2D:
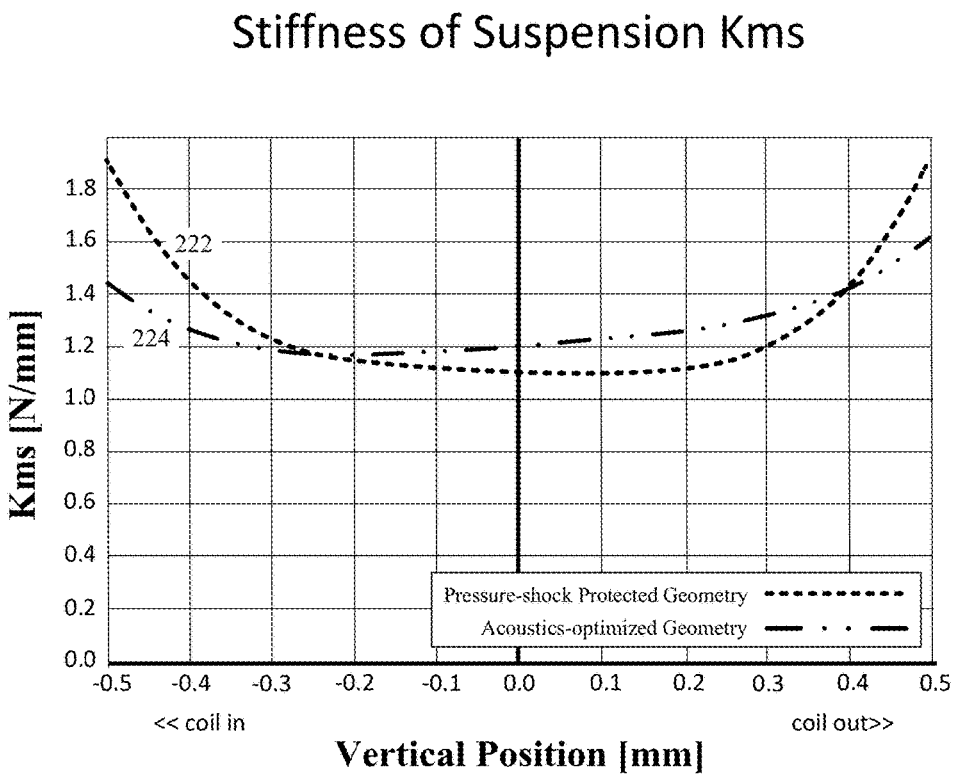
FIG. 2D shows a graph illustrating the stiffness provided by a speaker assembly suspension as a function of how far the diaphragm travels away from a neutral position.

FIG. 2D shows a graph representing the stiffness provided by the speaker assembly suspension as a function of how far the diaphragm travels away from a neutral position. This graph includes curve 222, representing the stiffness provided by a speaker surround optimized for pressure-shock protection, such as speaker surround 202 (see FIG. 2B) and curve 224, representing the stiffness provided by a speaker surround optimized for acoustic performance where the speaker surround has a substantially uniform thickness. As depicted by curve 222, the tapered speaker surround configuration provides a consistent amount of stiffness within about 0.3 mm from a neutral position. Outside that range, stiffness provided by the speaker surround increases rapidly, thereby preventing the diaphragm from moving too far away from the neutral position during pressure excursions. As depicted by curve 224, while performance of the acoustically optimized surround maintains a substantially flat profile within desired operating limits, this configuration does not provide the same steeply increasing resistance to deflection outside of normal operating parameters. Unfortunately, this can lead to the diaphragm crashing into the speaker housing and causing undesirable degradation of the audio output, as depicted in FIGS. 1B and 1C.

Figure 3A:
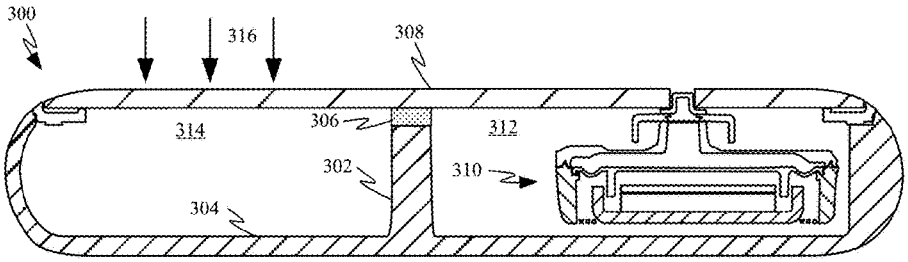
FIGS. 3A-3B show alternative methods of reducing adverse effects on audio performance caused by changes in pressure within the portable electronic device.
Figure 3B:
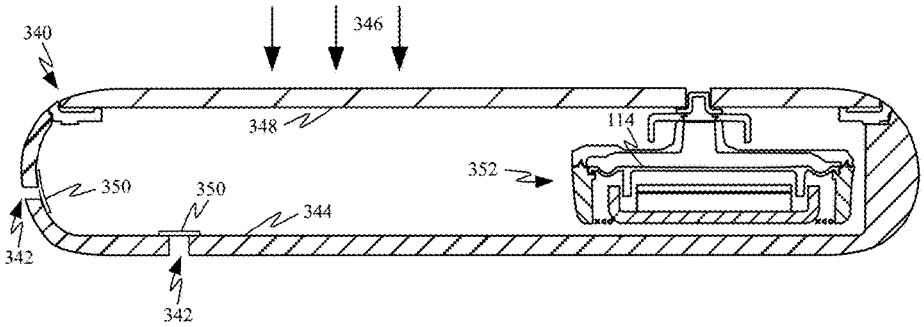

FIGS. 3A-3B show alternative methods of reducing adverse effects on audio performance caused by changes in pressure within the interior volume of the portable electronic device. FIG. 3A shows portable electronic device 300 and how by incorporating a bulkhead 302 into housing 304 and adding a compressible member 306 between coverglass 308 and bulkhead 302 the device can be partitioned into two or more independently pressurized regions 312 and 314. In this way, region 312, which includes a speaker assembly 310, can be subject to a substantially smaller change in pressure when force 316 causes a portion of coverglass 308 positioned over region 314 to deflect, resulting in a lower pressure increase in region 312. In some embodiments, compressible member 306 can take the form of a layer of foam that seals region 312 from region 314.

It should be noted that while regions 312 and 314 as depicted in FIG. 3A appear to be substantially the same size that the volumetric ratio between regions 312 and 314 can be substantially different. For example, region 314 could be substantially smaller than region 312 and could correspond to a region directly below a primary user input region of coverglass 308. By partitioning the area directly below the primary user input region from the rest of the device, a majority of the pressure changes resulting from user input can be isolated in a region of the device that doesn't include speaker assembly 310. This also allows the volume associated with speaker assembly 310 to be made proportionally larger and increases the effective back volume of speaker assembly 310. Alternatively, in devices where coverglass 308 has no primary input region or inputs are at least more random in nature, the size of region 312 could be substantially smaller than region 314 so that the frequency with which a user input is received above region 312 is minimized.

FIG. 3B shows a portable electronic device 340 and how multiple vents 342 can be defined by housing 344. The size and number of vents 342 can be increased to improve the rate at which air is able to enter and leave housing 344 in response to the application of force 346 on coverglass 348. In embodiments where portable electronic device 340 is a water-resistant device, membranes 350 can cover vents 342 in order to prevent water from entering into housing 344. By making vents 342 larger and including additional vents 342 within housing 344, the interior volume of portable electronic device 340 is able to equalize its internal pressure more quickly. This can result in a much shorter duration of adverse effects on the operation of speaker assembly 352 resulting from the application of force 346. It should be appreciated that while a single membrane 350 is shown covering each of vents 342, various securing mechanisms would generally be applied to secure membranes 350 in place within housing 344. It should be noted that any of the aforementioned mechanisms designed to accommodate pressure changes within the interior volume can be used alone or in combination to improve the performance of the speaker assembly.

Speaker Assembly with Top-Mounted Spring Contacts

Figure 4:
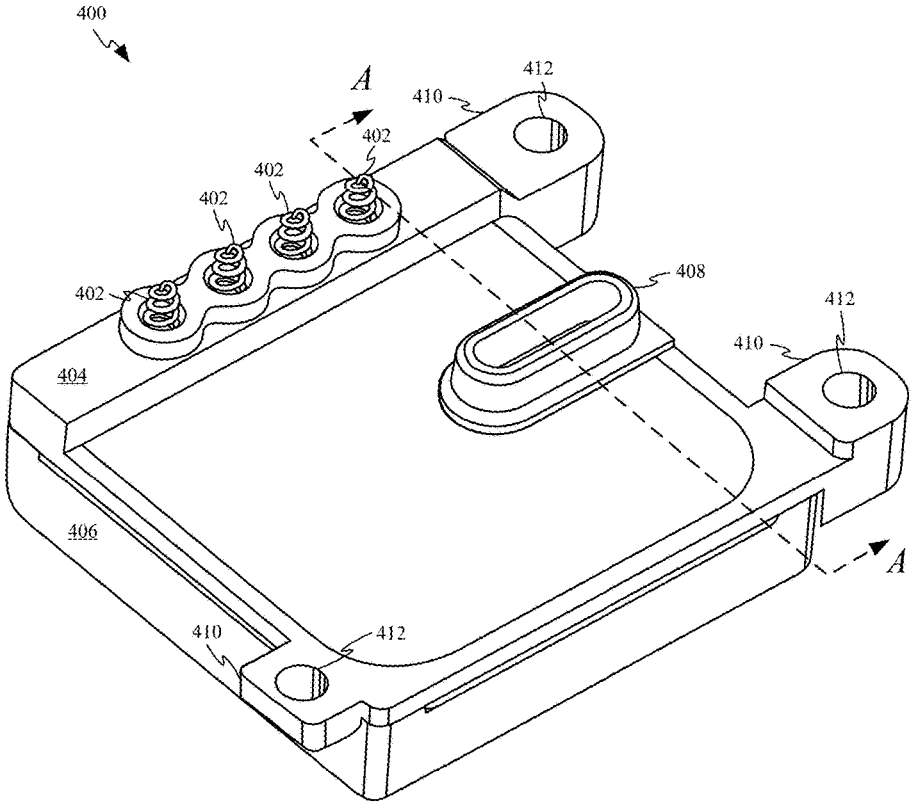
FIG. 4 shows a perspective view of a speaker assembly having a series of spring contacts arranged along an upper surface of a housing component.

FIG. 4 shows a perspective view of a speaker assembly 400 having a series of spring contacts 402 arranged along an upper surface of upper housing component 404. Spring contacts 402 can be configured to accommodate manufacturing tolerances when electrically coupling speaker assembly 400 with another component. For example, in some embodiments, spring contacts can be electrically coupled with a flexible circuit associated with a display assembly. Upper housing component 404 cooperates with lower housing component 406 to enclosure a number of speaker components. Both upper and lower housing components 404 and 406 can be formed primarily from electrically insulating material that helps insulate electrically conductive pathways within speaker assembly 400. Upper housing component 404 defines a port 408 through which audio waves generated by the speaker components can exit speaker assembly 400. By positioning spring contacts 402 along the top surface of speaker assembly 400 instead of incorporating spring contacts 402 within speaker assembly 400, the size of the diaphragm within speaker assembly 400 can be maximized on account of the speaker assembly not needing to accommodate spring contacts 402 and the diaphragm in the same plane. Upper housing component 404 also includes a number of attachment features 410 for securing speaker assembly 400 to one or more other components. For example, an opening 412 defined by one of attachment features 410 can be configured to receive a fastener for securing speaker assembly 400 to an electrical component such as a display assembly.

Figure 5A:
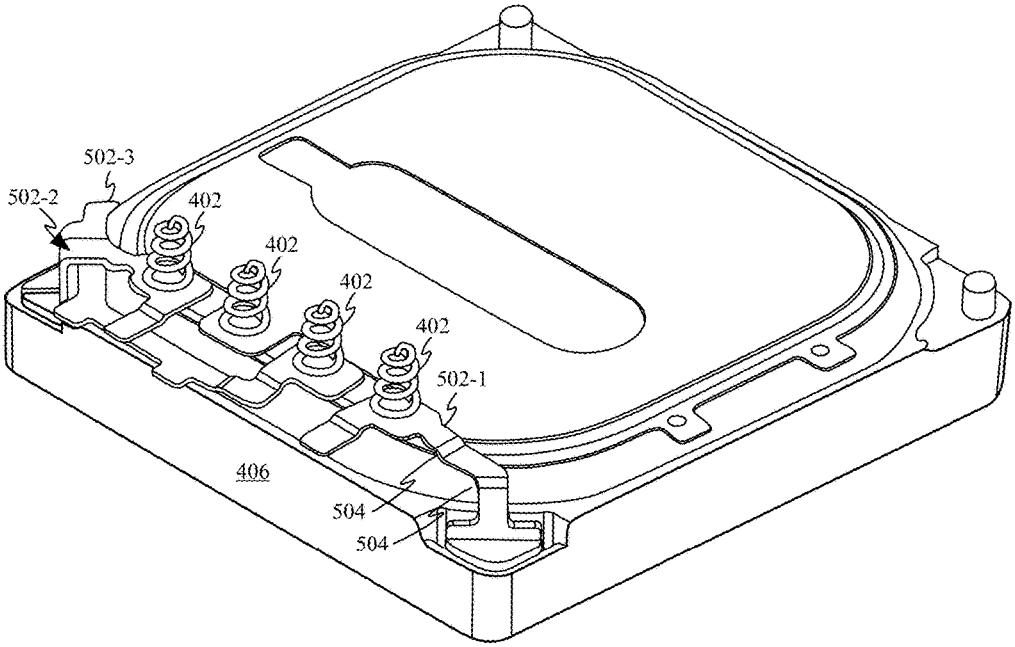
FIG. 5A shows a perspective view of a housing component as well as the positions of contact bars and spring contacts of the speaker assembly.
Figure 5B:
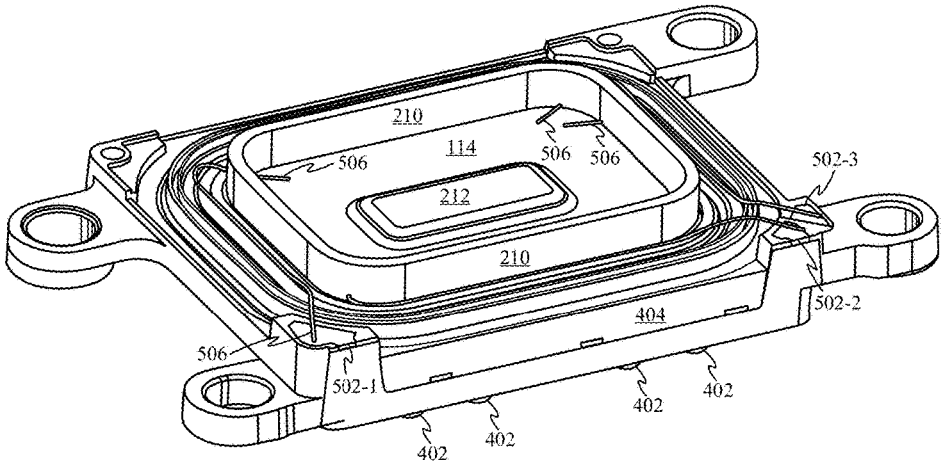
FIG. 5B shows a perspective view of a housing component facing downwards to expose electrical components incorporated within the speaker assembly.

FIG. 5A shows a perspective view of lower housing component 406 as well as the positions of contact bars 502 and spring contacts 402, which are both incorporated within upper housing component 404 (see FIG. 5B). Upper housing component 404 can be formed of electrically insulating material, such as plastic and has been removed in order to show the position of contact bars 502 and spring contacts 402 relative to each other and relative to lower housing component 406. Contact bars 502 are operable to route electrical signals and power to and from spring contacts 402 to electrical components of speaker assembly 400. In some embodiments, contact bars 502 can be formed by stamping and shaping sheet metal into desired shapes and sizes. In particular, contact bar 502-1 includes multiple bends 504 configured to maneuver contact bars 502 vertically from spring contacts 402 to a down-ward facing surface of upper housing component 404. In some embodiments, contact bars 502-2 and 502-3 can be configured to carry power to and from electrical components within speaker assembly 400. Contact bar 502-1 can be configured to carry signal data to and from a sensor associated with speaker assembly 400. For example in some embodiments, speaker assembly 400 can include a capacitive sensor configured to route signals back and forth through one of spring contacts 402.

FIG. 5B shows upper housing component 404 facing downwards to expose electrical components incorporated within upper housing component 404. As depicted, contact bars 502 are incorporated within upper housing component 404. In some embodiments, contact bars 502 can be embedded within the material forming the majority of upper housing component 404 by way of an insert-molding operation. By insert-molding contact bars 502 within upper housing component 404, power and/or signals can be routed through upper housing component 404 without having to route electrically conductive pathways along external surfaces of upper housing component 404. Each of wires 506 can be laser welded to one of contact bars 502 and be configured to route power and/or data from contact bars 502 to various electrical components within speaker assembly 400. Wires 506 are also shown routing the power and/or data around electromagnetic coil 210. A speaker backer, such as speaker backer 211, can be cooperate with lower housing component 406 in order to protect wires 506 and coil 210 from damage. By routing contact bars 502 in this manner speaker surround 202, which is coupled to diaphragm 114, can extend directly beneath spring contacts 402, substantially increasing the effective size of diaphragm 114 without increasing the size of speaker assembly 400. It should be noted that FIG. 5B also depicts central recessed portion 212 of diaphragm 114.

Figure 6A:
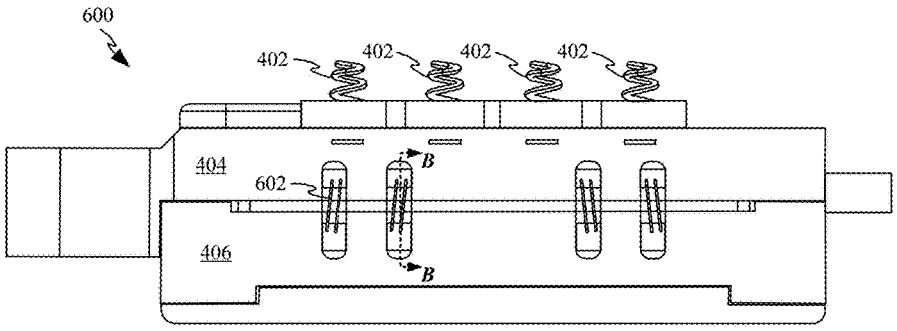
FIG. 6A shows a side view of a speaker assembly utilizing an alternative system of electrical and power interconnects.
Figure 6B:
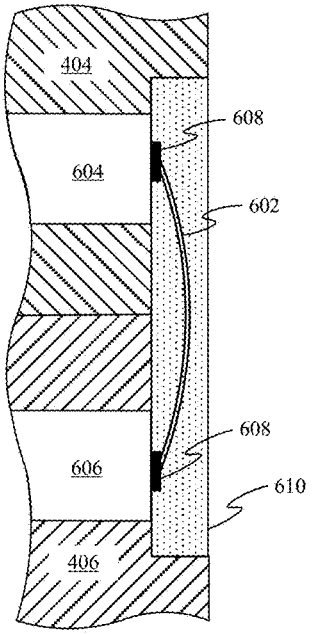
FIG. 6B shows a cross-sectional view of a portion of the speaker assembly depicted in FIG. 6A in accordance with section line B-B.

FIG. 6A shows a side view of a speaker assembly 600 utilizing a different system of electrical and power interconnects. In particular, FIG. 6A shows how wires 602 can be configured to form a portion of an electrically conductive pathway configured to route power and signals from one of spring contacts 402 to electrical components within lower housing component 406. FIG. 6B shows a cross-sectional view of a portion of speaker assembly 600 in accordance with section line B-B as depicted in FIG. 6A. FIG. 6B shows wire 602 soldered to contacts 604 and 606 by solder 608. Multiple wires 602 can be soldered to one set or multiple sets of contacts. After wires 602 have been soldered to the contacts, electrically-insulating filler 610 can surround and fill a recess to protect wires 602 from being inadvertently damaged. In some embodiments, wires 602 can be gold wires and solder 608 can take the form of a liquefied portion of wire 602 adhered to contacts 604.

Figure 7A:
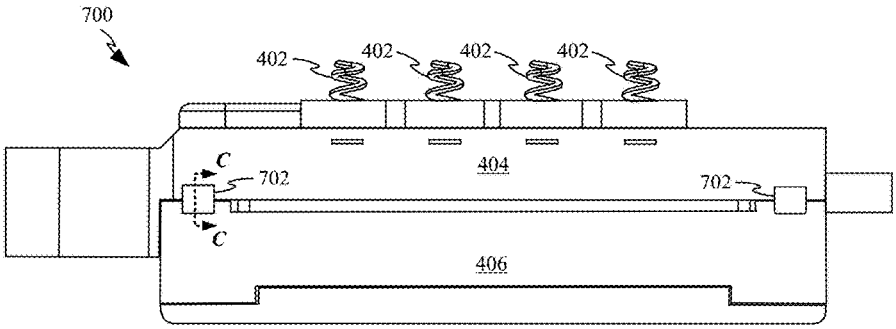
FIG. 7A shows a side view of a speaker assembly utilizing another alternative system of electrical and power interconnects.
Figure 7B:
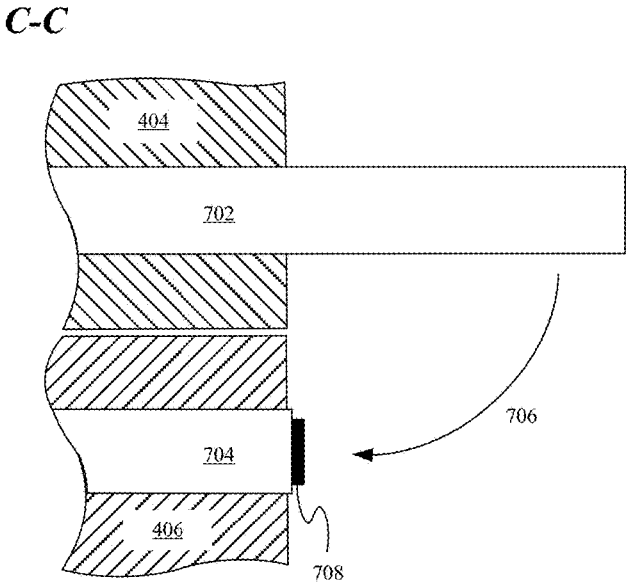
FIG. 7B shows a cross-sectional view of the speaker assembly depicted in FIG. 7A in accordance with section line C-C and how an electrically conductive tab can be folded towards a housing component of the speaker assembly.
Figure 7C:
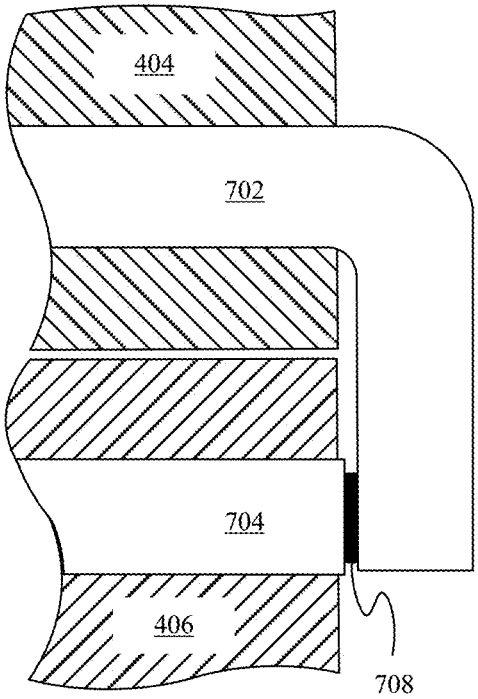
FIG. 7C shows the electrically conductive tab depicted in FIG. 7B soldered to another electrically conductive tab.

FIG. 7A shows a side view of a speaker assembly 700 utilizing another different system of electrical and power interconnects. In particular, speaker assembly 700 includes a series of electrically conductive tabs 702 protruding from one of upper housing component 404 and lower housing component 406. FIG. 7B shows a cross-sectional view of speaker assembly 700 in accordance with section line C-C of FIG. 7A. FIG. 7B illustrates how electrically conductive tab 702 can be folded towards the lower housing component 406 in direction 706. In order to suit this function electrically conductive tabs 702 can be formed of a highly conductive material such as copper and have a thickness thin enough to allow electrically conductive tabs 702 to be folded. FIG. 7B also shows how solder 708 can be applied to electrically conductive tab 704 prior to folding electrically conductive tabs 702. FIG. 7C shows electrically conductive tab 702 folded against and soldered to electrically conductive tab 704 by solder 708. In this way, an electrically conductive pathway can be established between upper housing component 404 and lower housing component 406.

Figure 8A:
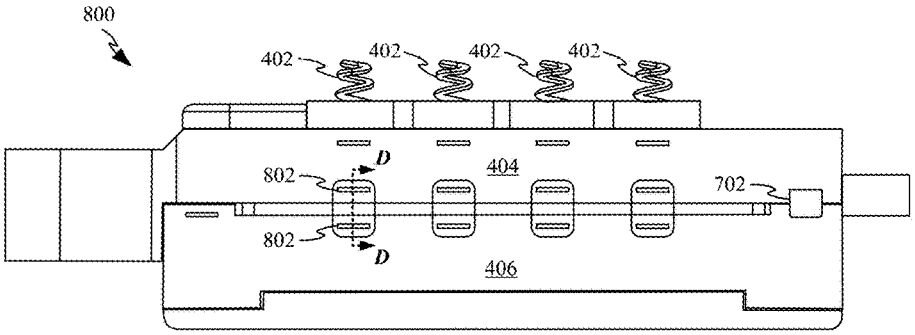
FIG. 8A shows a side view of another speaker assembly utilizing another different system of electrical and power interconnects.
Figure 8B:
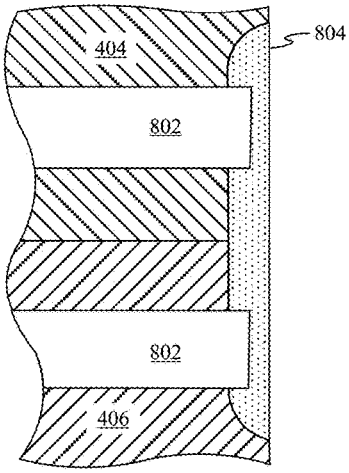
FIG. 8B shows a side view of the speaker assembly depicted in FIG. 8A in accordance with section line D-D.

FIG. 8A shows a side view of a speaker assembly 800 utilizing another different system of electrical and power interconnects. In particular, speaker assembly 800 includes a series of electrically conductive tabs 802 protruding from both upper housing component 404 and lower housing component 406. FIG. 8B shows a side view of speaker assembly 800 in accordance with section line D-D. FIG. 8B shows how a recess defined by the exterior surface of the upper and lower housing components can be filed with solder 804 to electrically couple electrically conductive tabs 802 together. In this way, electrical signals and power can be routed between upper and lower housing components 404 and 406. In some embodiments an insulating patch or layer can be applied over solder 804 to prevent inadvertent shorts caused by speaker assembly 800 contacting another electrical component.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A portable electronic device, comprising:
- a device housing;
- an electronic display assembly coupled to the device housing to define a first interior volume;
- a speaker assembly coupled to an interior-facing surface of the electronic display assembly and disposed within the first interior volume, the speaker assembly, comprising:
  - a speaker housing having a plurality of walls defining a second interior volume,
  - a diaphragm disposed within the second interior volume, and
  - an electrically conductive coil coupled to the diaphragm and electrically coupled to the electronic display assembly by an electrically conductive pathway at least partially embedded within a wall of the plurality of walls of the speaker housing.

2. The portable electronic device as recited in claim 1, further comprising a speaker surround coupling the diaphragm to the walls of the speaker housing, the speaker surround having a tapered geometry that includes a central region that is substantially thinner than both a first region of the speaker surround that is coupled to the diaphragm and a second region of the speaker surround that is coupled to the speaker housing.

3. The portable electronic device as recited in claim 2, wherein a thickness of the central region of the speaker surround is tuned to achieve a desired frequency response of the diaphragm.

4. The portable electronic device as recited in claim 1,
- wherein the electronic display assembly includes a plurality of electrical components; and
- wherein the speaker assembly further comprises a plurality of spring coils arranged along an exterior surface of the speaker housing and electrically coupled with the plurality of electrical components.

5. The portable electronic device as recited in claim 4, wherein the spring coils are electrically coupled to electrical components within the speaker assembly by electrically conductive pathways at least partially embedded within walls of the speaker housing.

6. The portable electronic device as recited in claim 5, wherein the electrically conductive pathways are insert molded within the speaker housing.

7. The portable electronic device as recited in claim 6, further comprising a plurality of wires bonded to exposed surfaces of the electrically conductive pathways insert-molded within the speaker housing.

8. The portable electronic device as recited in claim 5, wherein the electrically conductive pathways are embedded along the exterior surface of the speaker housing.

9. A small form factor electronic device, comprising:

a device housing defining an interior volume;

a speaker assembly disposed within the interior volume and comprising:

a speaker housing comprising a plurality of walls, a diaphragm disposed within the speaker housing, and an electrical component coupled to the diaphragm and electrically coupled to an electronic display assembly by an electrically conductive pathway at least partially embedded within a wall of the plurality of walls of the speaker housing.

10. The small form factor electronic device as recited in claim 9, wherein the speaker assembly further comprises a plurality of spring coils mounted to an exterior surface of the speaker housing.

11. The small form factor electronic device as recited in claim 10, further comprising a display assembly cooperating with the device housing to define the interior volume, wherein the plurality of spring coils is electrically coupled to electrical contacts of the display assembly.

12. The small form factor electronic device as recited in claim 9, wherein the speaker housing comprises an upper housing component and a lower housing component and the electrically conductive pathway is embedded within a wall of both the lower housing component and the upper housing component.

13. The small form factor electronic device as recited in claim 9, wherein the diaphragm defines a recessed central portion protruding away from an exit audio port of the speaker housing.

14. The small form factor electronic device as recited in claim 12, wherein the upper housing component defines an exit audio port.

15. A portable electronic device, comprising:

a housing defining a front opening;

a display assembly covering the front opening and cooperating with the housing to define an interior volume; and a speaker assembly, comprising:

a speaker housing comprising a plurality of walls, a diaphragm disposed within the speaker housing, and an electrical component coupled to the diaphragm and electrically coupled to the display assembly by an electrically conductive pathway at least partially embedded within a wall of the plurality of walls of the speaker housing.

16. The portable electronic device as recited in claim 15, wherein the speaker assembly further comprises:

a permanent magnet, and wherein the electrical component is an electrically conductive coil that is configured to receive a modulated electrical current from the electrically conductive pathway that causes the electrically conductive coil to emit a shifting magnetic field that interacts with the permanent magnet to move the diaphragm in a manner that generates audio content.

17. The portable electronic device as recited in claim 15, further comprising a plurality of electrically conductive pathways at least partially embedded within the walls of the speaker housing.

18. The portable electronic device as recited in claim 15, wherein the electrically conductive pathway is insert-molded within one or more of the plurality of walls of the speaker housing.

19. The portable electronic device as recited in claim 15, further comprising a speaker surround coupled to and extending around a periphery of the diaphragm, the speaker surround also being coupled to the speaker housing and having a tapered geometry that limits displacement of the diaphragm without degrading a frequency response of the diaphragm, wherein the speaker surround is formed from molded silicone.

* * * * *